United States Patent [19]

Dickens

[11] 4,401,413

[45] Aug. 30, 1983

[54] AIR COMPRESSOR SWITCH DEVICE

[76] Inventor: Willie G. Dickens, 110 Blackstone Pl., Nashville, Tenn. 37211

[21] Appl. No.: 271,676

[22] Filed: Jun. 8, 1981

[51] Int. Cl.[3] ..... F04B 49/02; F04B 49/08

[52] U.S. Cl. ..... 417/26; 417/44; 417/38

[58] Field of Search ..... 417/26, 28, 38, 44, 417/45

[56] References Cited

U.S. PATENT DOCUMENTS

| | | | |
|---|---|---|---|
| 1,315,433 | 9/1919 | Tatum | 417/28 |
| 1,473,078 | 11/1923 | Clapp | 417/28 |
| 1,521,034 | 12/1924 | Maxson | 417/28 |
| 1,910,202 | 5/1933 | Crago | 417/44 |
| 2,389,348 | 11/1945 | Dustin | 417/28 |
| 2,446,740 | 8/1948 | Burns | 417/40 |
| 3,072,319 | 1/1963 | Cox et al. | 417/28 |
| 3,334,285 | 8/1967 | Blake | 417/45 |

*Primary Examiner*—William L. Freeh

*Attorney, Agent, or Firm*—Harrington A. Lackey

[57] ABSTRACT

A switch device for an air compressor plant including an air receiver, an air compressor having an unloader valve mechanism, an electrical motor for driving the compressor, and an electrical supply circuit including a main line for energizing the motor and a pair of capacitor circuits, comprising a pneumatically actuated air valve in an air line between the air receiver and the unloader valve mechanism, in which the air valve is adapted to be opened when excessive pressure is developed in the air receiver for supplying air through an unloader control line to the unloader mechanism. Also, included in the unloader air line is a pneumatic switch actuator device adapted to automatically and simultaneously open switches in the main supply line circuit and the capacitor circuits when the air valve is open. The unloader control air line is also supplied with a relief or exhaust valve which has a normally closed position when the air valve is open, and an open exhaust position for exhausting the unloader control air line as well as the switch actuator device when the air valve is closed.

4 Claims, 9 Drawing Figures

AIR COMPRESSOR SWITCH DEVICE

BACKGROUND OF THE INVENTION

This invention relates to air compressor controls, and more particularly to an air compressor switch device.

Air compressor control devices for relieving excess air pressure in the air tank or receiver, and control devices for cutting out or stopping the air compressor motors, are known in the art. Air compressor unloader mechanisms of various types are also well known in the art.

Some examples of various types of air compressor control devices are disclosed in the following U.S. patents:

U.S. Pat. No. 1,634,542—Holdsworth—July 5, 1927
U.S. Pat. No. 1,663,214–Muller et al.—Mar. 20, 1928
U.S. Pat. No. 1,838,228–Kershaw—Dec. 29, 1931
U.S. Pat. No. 2,585,168—Platts—Feb. 12, 1952
U.S. Pat. No. 2,646,204—Munck AF Rosenschold—Jul. 21, 1953
U.S. Pat. No. 2,720,355—Widmyer—Oct. 11, 1955
U.S. Pat. No. 3,119,551—Beeman—Jan. 28, 1964
U.S. Pat. No. 3,122,349—Kaminky—Feb. 25, 1964

All of the above patents disclose various types of air compressor control circuits, including a control for an unloader valve and also a motor control.

The Muller et al U.S. Pat. No. 1,663,214 discloses a controller mechanism including a diaphragm device actuated by the pressure in the air receiver both for cutting out the main power lines to the motor and also for controlling the unloader mechanism.

The Kershaw U.S. Pat. No. 1,838,228 discloses a different mechanism for accomplishing the same results as that in the above Muller patent.

However, none of the above patents disclose a device having a diaphragm-controlled pressure breaker for actuating an air valve which operates both the unloader mechanism and a pneumatically-controlled switch device for simultaneously opening the main motor circuit and the motor capacitor circuits.

SUMMARY OF THE INVENTION

It is therefore an object of this invention to provide an improved air compressor device, and more specifically, a pneumatically-controlled switch device for simultaneously actuating the existing unloader mechanism and for simultaneously breaking the main motor circuit and motor capacitor circuits when the air pressure in the compressor tank or receiver exceeds a predetermined value.

The air compressor switch device, made in accordance with this invention, includes an air valve having a lever trigger and having its inlet connected to the air receiver and its outlet connected to the existing unloader chamber on a conventional air compressor. A pressure breaker including an air chamber having a diaphragm sensitive to the air pressure in the receiver is mechanically linked to the lever trigger so that the air valve is opened when the air pressure within the receiver exceeds a predetermined pressure. The outlet from the air valve is also connected to a pneumatic switch actuator chamber operative to simultaneously open three sets of switches in the main motor line and the two capacitor circuit lines, respectively, when the air valve is opened. The outlet from the air valve is also in fluid communication with an automatic release or exhaust valve normally closed when the air valve is opened to discharge air to the unloader mechanism. When the air valve is closed, the exhaust valve opens to discharge air from the switch actuator chamber to the atmosphere.

This switch device also preferably includes a manually actuated control device for simultaneously opening the air valve and an auxiliary main motor line switch, when the manual control device is moved to its operative position.

BRIEF DESCRIPITION OF THE DRAWINGS

DESCRIPTION OF THE PREFERRED EMBODIMENTS

Figure 1:
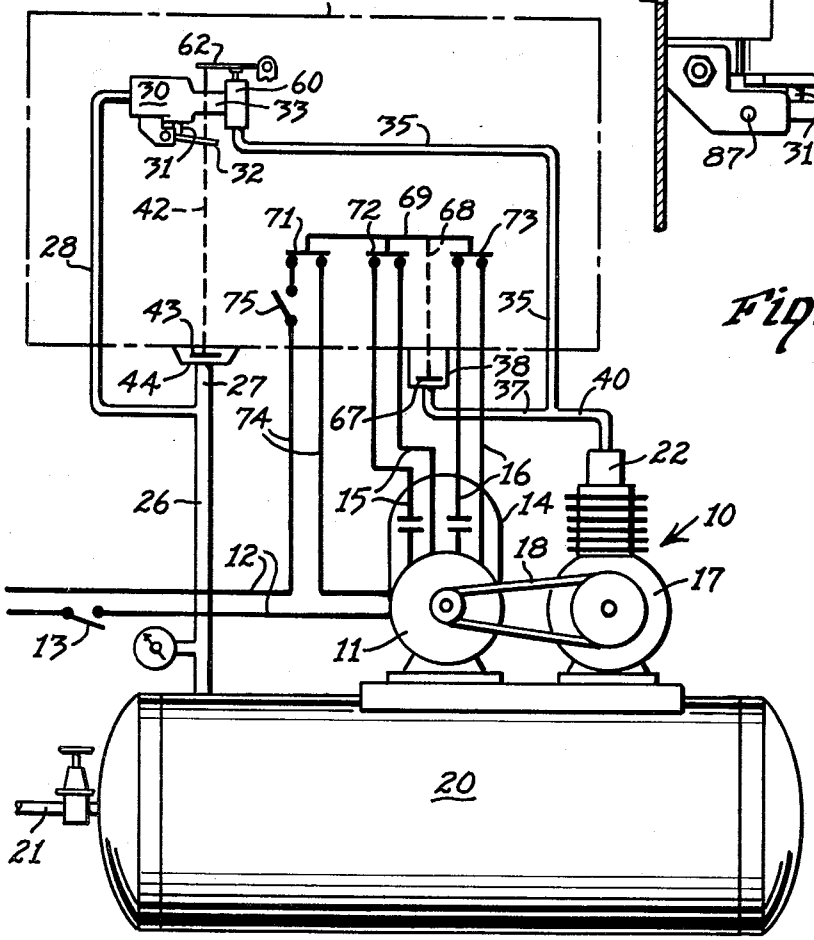
FIG. 1 is a schematic view of the switch device made in accordance with this invention assembled upon a conventional air compressor plant.

Referring now to the drawings in more detail, FIG. 1 discloses a conventional air compressor plant 10, including an electrical motor 11 supplied with electric current through a main drive or motor circuit 12 including a main on-off switch 13. Mounted upon the motor 11 is a conventional motor control mechanism 14 including a pair of capacitor circuits 15 and 16. The electrical motor 11 drives the air compressor 17 through a convenient transmission, such as the drive belt 18, for compressing air which is stored in the air receiver or tank 20. Compressed air is discharged through the delivery pipe 21 for useful work in any convenient pneumatically driven tool or other equipment, not shown. Mounted upon the air compressor 17 is a conventional unloader valve or mechanism 22 for discharging compressed air to the atmosphere when appropriately actuated as a result of excessive air pressure.

The air compressor switch device 25, made in accordance with this invention, is schematically disclosed in FIG. 1 as being mounted upon and connected to the air compressor plant 10. The mechanical details of the switch device 25 are disclosed in FIGS. 2–9.

As disclosed in FIG. 1, an air outlet line 26 is connected to, and in fluid communication with, the air receiver 20, and is also connected to a breaker inlet line 27 and an air valve inlet line 28. The air inlet line 28 is connected to a main air valve 30, disclosed in the form of a conventional air gun having a trigger button 31 adapted, when depressed, to open the valve 30 to permit passage of air therethrough. A trigger lever 32 is pivotally mounted upon the air gun 30 for operative engagement with, and depression of, the trigger button 31. When the trigger lever 32 is pivoted upward, such as disclosed in FIG. 7, it forces upward the trigger button 31 to open the valve 30 and to permit the flow of compressed air from the inlet line 28 through the valve 30 and outward through the valve outlet 33.

The valve outlet 33 is connected to a T-coupling 34, one leg of which is connected to a valve outlet line 35. The other end of the outlet line 35 is connected to a T-junction 36 (FIG. 4) from which extends one branch line 37 to the bottom of the air chamber 38 of the pneumatic switch actuator device 39. Extending from the other branch of the T-junction is the unloader air line 40, connected to the unloader valve mechanism 22.

As disclosed in FIG. 1, the trigger lever 32 is controlled by a linkage mechanism 42 actuated by the diaphragm 43 within the pneumatic breaker chamber 44.

Figure 6:
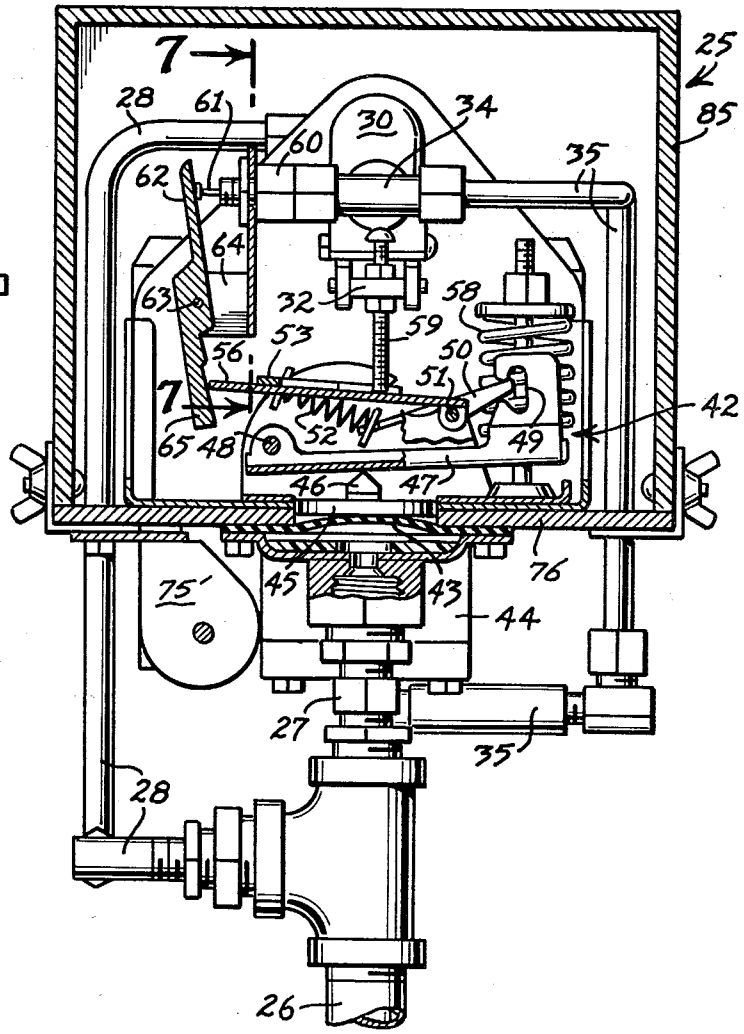
FIG. 6 is a section taken along the line 6—6 of FIG. 3, in operative position to open the air valve.
Figure 7:
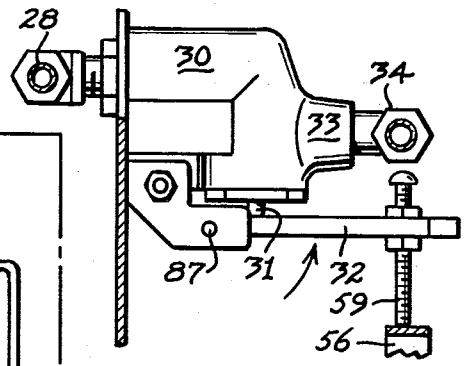
FIG. 7 is a fragmentary section taken along the line 7—7 of FIG. 6.
Figures 4, 5, 8, 9:
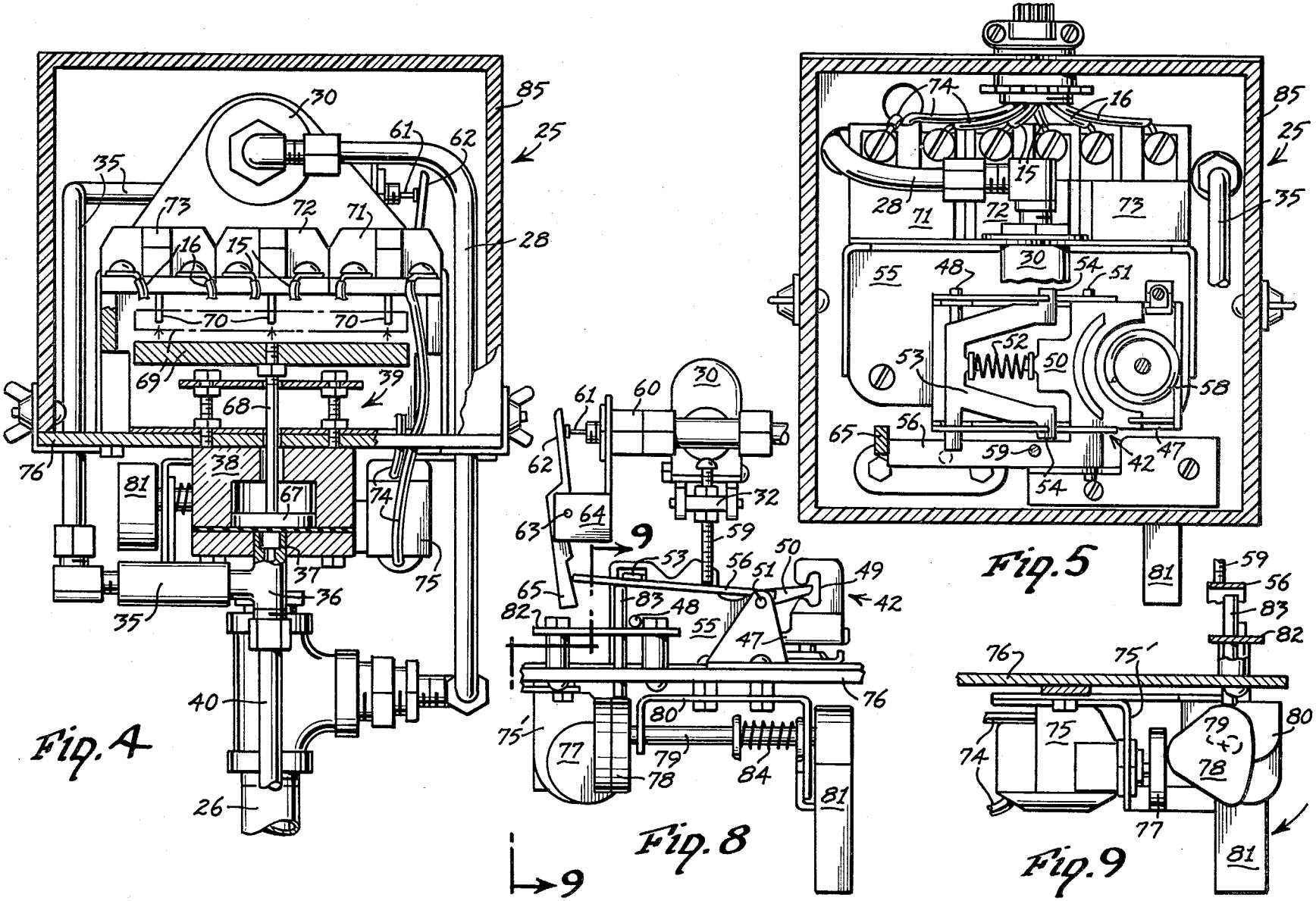
FIG. 4 is a fragmentary section taken along the line 4—4 of FIG. 3.
FIG. 5 is a section taken along the line 5—5 of FIG. 3.
FIG. 8 is a fragmentary front elevation of portions of FIG. 2, illustrating the manual control device in operative position.
FIG. 9 is a fragmentary section taken along the line 9—9 of FIG. 8.

As best disclosed in FIG. 6, the flexible plastic or rubber diaphragm 43, within the breaker chamber 44, supports a piston disc 45 carrying upward projecting ears 46 engaging the bottom of a pivotal plate 47 pivoted about pivot pin 47, and forming a part of the general pressure breaker linkage 42. As viewed in FIG. 6, the right end portion of the pivotal plate 47 is provided with a notch 49 receiving the right end of another pivotal plate 50 journaled about pivot pin 51. The left end portion of the pivotal plate 50 is connected to one end of a snap spring 52, the opposite end of which is connected in the bight of a U-shaped pivotal plate 53 (FIG. 5). The free ends of the U-shaped plate 53 form laterally projecting ears 54 loosely pivotally held in corresponding slots, not shown, in a portion of the frame 55. The U-shaped plate 53 is also fixed along one side to a pivotal arm 56, which is also journaled about the pivot pin 51.

The right end portion of the pivotal plate 47 is maIntained in a lower position by the coil spring 58.

Depending from the free end of the trigger lever 32 is an elongated bolt or stud 59 adapted to engage the top portion of the pivotal arm 56.

Projecting from one branch of the T-coupling 34 is a relief valve 60 (FIGS. 2 and 6) having a valve member, not shown, spring-biased to a normally closed position (FIG. 6) and having a projecting actuator pin 61. The relief valve 60 functions like a bicycle tire valve. The projecting actuator pin 61 is adapted to engage the upper end of an actuator lever 62 journaled about pin 63 in bracket 64 and having a lower end portion 65 with a cam surface for engaging the free end of the pivotal arm 56. Thus, when the pivotal arm 56 is in its normally inoperative lower position (FIG. 2), it engages the lower cam portion 65 to force the upper portion of the lever 62 against the actuator pin 61 to depress the actuator pin 61 and valve member (not shown) to maintain the relief valve 60 in an open position for discharging air from the T-coupling 34 to the atmosphere. When the pivotal arm 56 is spring-biased in its upper position, as disclosed in FIG. 6, the lever 62 is forced by the spring-biased actuator pin 61 in a counter-clockwise direction to permit the relief valve 60 to close.

As best disclosed in FIG. 4, a piston 67 carrying an actuator rod 68 is mounted in the pneumatic switch chamber 38. The upper end of the rod 68 carries a transverse switch bar 69 adapted, when raised to the dashed-line positon of FIG. 4, to engage and thrust upward the switch fingers 70 of three microswitches 71, 72 and 73. The microswitch 71 has its contacts connected to the motor branch line 74, connected in series in one leg of the main motor line 12. The branch line 74 also includes an auxiliary motor switch 75. The switches 72 and 73 are connected in the respective capacitor circuits 15 and 16.

Figure 2:
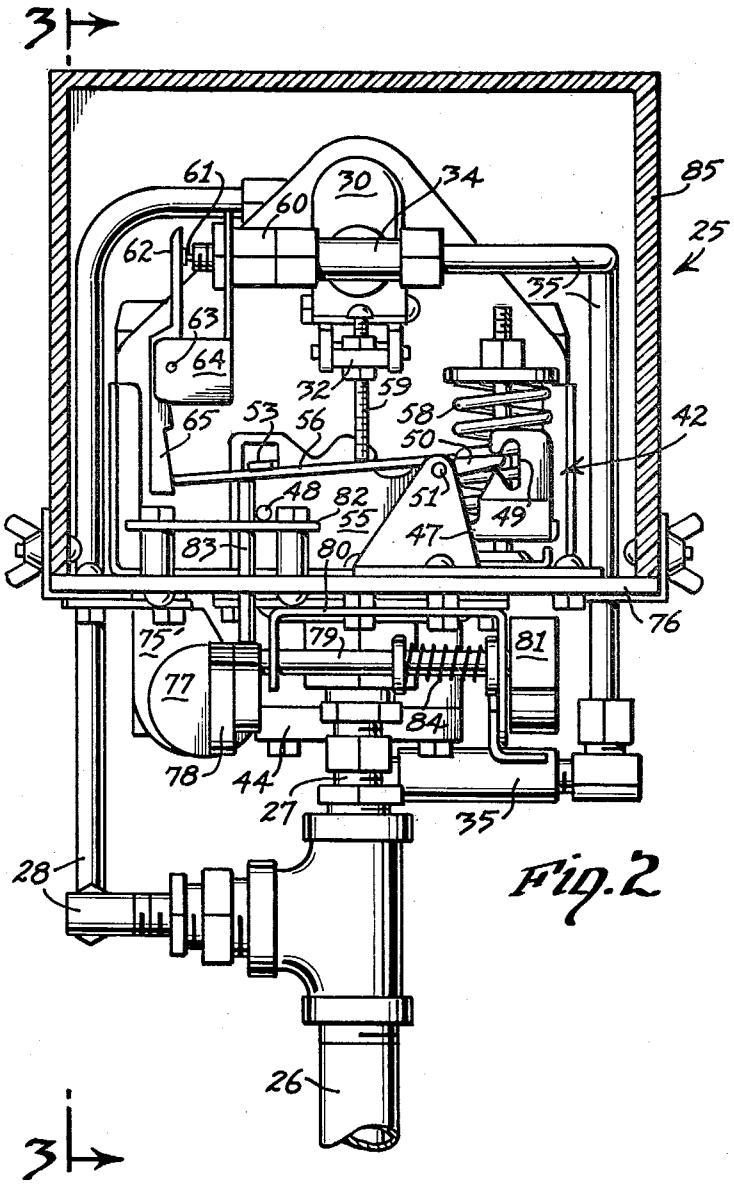
FIG. 2 is a front elevation of the switch device made in accordance with this invention, with the housing shown in section, the air line from the receiver shown fragmentarily, and in inoperative position to close the air valve.
Figure 3:
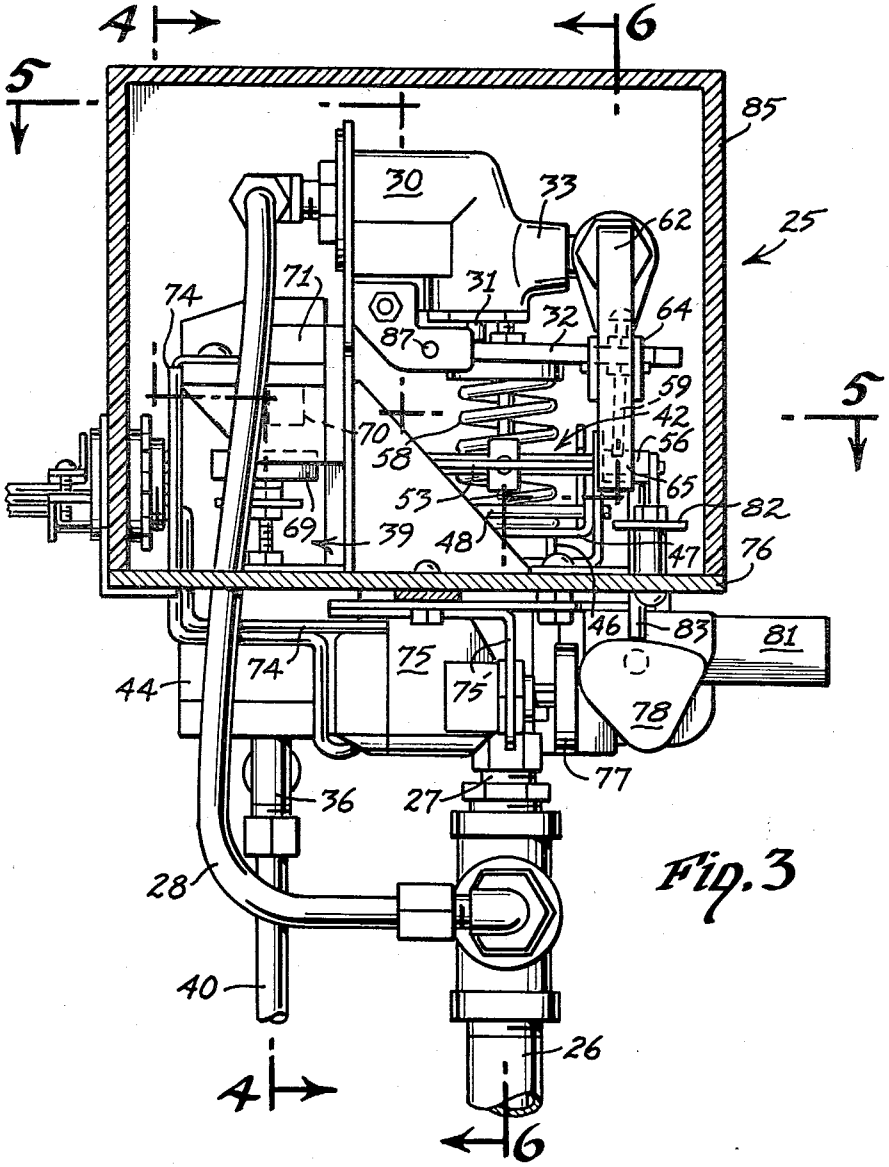
FIG. 3 is a section taken along the line 3—3 of FIG. 2.

The auxiliary switch 75 is fixed in bracket 75' to the bottom of the base or base plate 76 of the frame 55. The switch 75 is provided with an actuator push-button 77 adapted to be engaged by a rotary cam 78 (FIGS. 3 and 4) fixed on one end of a rotary shaft 79 journaled in the bracket 80 fixed to the bottom of the base plate 76 (FIGS. 2 and 8). On the opposite end of the rotary shaft 79 is fixed an elongated lever handle 81.

Supported in a bracket 82 on top of the base plate 76 is a vertically reciprocal pin 83 passing through the base plate 76 and also adapted to ride upon the upper surface of the cam 78 (FIGS. 2, 3, 8 and 9). The upper end of the reciprocal pin 83 is adapted to engage the bottom surface of the pivotal arm 56. The rotary shaft 79 may be provided with a coil spring 84 for returning the lever handle 81 to its upper inoperative position (FIG. 3), if desired.

The upper portion of the device 25 may be completely enclosed in a cover or housing 85, if desired.

In the operation of the switch device 25, when the air compressor plant 10 is operating normally, with the main switch 13 closed, and air is compressed and received in the air tank 20 at normal operating pressures, the entire device 25 will be in its inoperative mode. In the inoperative mode of the device 25, all of the microswitches 71, 72 and 73 will be closed, the auxiliary motor switch 75 will be closed, the diaphragm 43 in the air chamber 44 will be in its lower position so that the linkage 42 will be in its inoperative position as disclosed in FIG. 2, and air valve of air gun 30 will be closed. The relief valve 60 will be open to the atmosphere, and the piston 67 in the pneumatic switch air chamber 38 will be in its lower position with the switch bar 69 in its lower solid-line position disclosed in FIG. 4. Moreover, the lever handle 81 will be in its raised inoperative position, as disclosed in FIG. 3.

In the event that an abnormally high pressure is attained in the receiver 20, and the predetermined maximum pressure is exceeded, the excessive air pressure will flow through the outlet line 26 and the branch lines 27 and 28. The excessive pressure in the line 27 raises the diaphragm 43 to move the linkage mechanism 42, ultimately elevating the pivotal arm 56, thereby elevating the stud 59 and the trigger lever 32 to urge upward the switch button 31, thereby opening the valve 30 to permit the passage of compressed air therethrough.

When the lever arm 56 is elevated, pressure is removed from the lower cam portion 65 to the lever 62, to permit the actuator pin 61 of the relief valve 60 to be urged outward by its spring, not shown, thereby automatically closing the relief valve 60 to the atmosphere.

The compressed air passing through the air valve 30 discharges through the outlet 33, T-coupling 34, valve outlet line 35. The air flow then splits between the branch line 37 and the unloader line 40. The air in the brush line 37 elevates the piston 67, actuator rod 68, and switch bar 69 to its phantom position in FIG. 4, to engage the switch fingers 70 and simultaneously open all of the microswitches 71, 72 and 73, thereby immediately breaking the main circuit 12 through the branch line 74 to the motor 11, and also for immediately breaking the capacitor circuits 15 and 16 to de-energize the electric motor 11 and thereby de-actuate the air compressor 17. The immediate opening of the capacitor circuits 15 and 16 permits the electric motor to decelerate with a minimum of noise and chatter caused by the discharge of the capacitors. Such a switch actuating system eliminates the conventional drop-out relays incorporated in many electrical motors to eliminate the noise and vibration of the discharging capacitors.

The compressed air moving through the unloader line 40 discharges into the conventional unloader valve mechanism 22 to actuate the same, in a well-known manner, for discharging the excessively pressurized air to the atmosphere.

The automatic closing of the relief valve 60 prevents the loss of compressed air through the valve 60 during the operative mode of the device 25.

Aftr the air pressure in the receiver 20 returns to normal, the pressure breaker diaphragm 43 descends to restore the breaker linkage 42 to its original position disclosed in FIG. 2, lowering the pivotal arm 56 to cam the lever 62 back to depress the actuator pin 61 and open the relief valve 60. The lowering of the trigger lever 32 closes the valve 30 so that no more compressed air is discharged through the valve 30 and the lines 35, 37 and 40. The opening of the relief valve 60 permits the exhaustion of compressed air from all of the lines 35, 37 and 40. The switch actuator piston 67 then returns to its lower position disclosed in FIG. 4 to lower the switch bar 69 to its solid-line position and permit the microswitches 71, 72 and 73 to re-engage and restore power to the motor 11. The unloader valve mechanism 22 is again returned to its normally closed position.

The lever handle 81 and its associated mechanism is a safety override device which can be used to manually shut down the air compressor plant 10 by depressing the handle 81. When the handle 81 is depressed (FIG. 9) the cam 78, with its unique configuration and relative position disclosed in FIG. 8, performs a dual function. First of all, one lobe of the cam 78 depresses the switch button 77 to open the auxiliary switch 75 and thereby open the main circuit to the electrical motor 11 to shut down the air compressor 17. The second function is performed by a second lobe in the rotary cam 78 engaging and simultaneously elevating the reciprocal rod 83 to force upward the pivotal arm 56, depending stud 59 and lever trigger 32 to open the air gun 30 to permit the passage of compressed air therethrough. This passage of compressed air will flow through the lines 35, 37 and 40, to enter the bottom of the pneumatic switch air chamber 38, and to actuate the unloader mechanism 22. If the pressure of the air in the chamber 38 is not sufficient to raise the piston 67, to open the switches 71, 72 and 73, the auxiliary switch 75 is open to shut down the motor 11 and air compressor 17.

The lever handle 81 may be moved downward to its operative position to shut down the plant 10 for long periods in which the plant 10 will not be attended, or for shutting down the plant 10 for any reason, even though the air pressure in the receiver does not exceed the maximum predetermined pressure for actuating the air gun 30.

One advantage of utilizing the air gun 30 as the main air valve is the capability of adjusting the value of the air pressure within a narrow range for opening the air valve 30. Such fine adjutment is attained by the placement of the lever trigger 32 so that the switch button 31 is very close to the pivot point 87 in relation to the free end of the trigger lever 32, thus giving the trigger lever 32 a substantial mechanical advantage. Moreover, the depending bolt or stud 59 is threaded through the outer portion of the trigger lever 32 for fine adjustment.

Because of the mechanical advantage of the various pivotal links in the pressure breaker linkage mechanism 42, only a small volume of compressed air is necessary to cause the flexible diaphragm 43 to travel a limited distance in order to cause the air gun 30 to open.

The air chamber 38 in the switch actuator device 39 has a greater height than the diaphragm chamber 44, to provide sufficient travel for the piston 67 to move the switch bar 69 far enough to effectively and swiftly open all three of the switches 71, 72 and 73, respectively.

The switches 71, 72 and 73 are provided internally with relatively strong springs for returning the switch contacts into solid closed engagement, when the pneumatic pressure is reduced to lower the switch bar 69, since the capacitors in the capacitor circuits 15 and 16 are under high voltage.

Accordingly, an improved air compressor switch device 25 has been devised, in which a pair of pneumatically controlled actuator devices, a first pressure breaker device 44 for opening a main valve 30 and a second pressure actuator device 39 for opening the three main switches 71, 72 and 73 in the electrical motor circuits, to immediately shut down the operation of the air compressor plant 10.

It will be noted that the maximum use is made of the compressed air, not only to open the air gun 30 and unload the unloader mechanism 22, but also to actuate the electrical switches thereby minimizing the amount of electrical circuitry utilized, and eliminating electrically actuated devices, except for the switches 71, 72, 73 and 75. The minimization of electrical devices reduces the hazard of worn or defective electrical components, particularly when used around compressed air.

Furthermore, a safety device 75–83 made in accordance with this invention incorporating a single manual control for executing the dual functions of opening an auxiliary switch 75 and closing the main air valve 30, is a substantial improvement over the prior art.

What is claimed is:

1. In an air compressor plant having an air receiver tank, an electrically-driven air compressor, including an unloader valve mechanism, for supplying compressed air to the receiver, and an electrical supply circuit, a switch device comprising:

(a) an air outlet line in fluid communication with the receiver, (b) air valve means having a valve inlet in fluid communication with said air outlet line, and a valve outlet, (c) pneumatic valve actuator means comprising a trigger lever operatively connected to said air valve means for opening and closing said air valve means, (d) an air chamber having a movable wall, (e) link means connecting said movable wall to said trigger lever, (f) a branch air line connecting said air chamber in fluid communication with said air outlet line, whereby said trigger lever is operable to open said air valve means when the air pressure in said air outlet line exceeds a predetermined value, (g) a main switch in the main drive circuit, (h) a capacitor switch in each of the capacitor circuits, (i) pneumatic switch actuator means for opening and closing said main switch and said capacitor switch, simultaneously, (j) said pneumatic switch actuator means being in fluid communication with said valve outlet, so that when said air valve means is open, said pneumatic switch actuator means opens said main switch and each said capacitor, (k) an unloader control air line in fluid communication with the unloader valve mechanism and said valve outlet, (l) a relief valve device in said unloader control air line operative between a closed position when said air valve means is open, and an open position exhausting said unloader control air line when said air valve means is closed, (m) said unloader control air line also being in fluid communication with said pneumatic switch actuator means, (n) an auxiliary switch in the main drive circuit having a reciprocal switch actuator member for opening said auxiliary switch, and (o) manual actuator means for moving said switch actuator member to open said auxiliary switch.

2. The invention according to claim 1 in which said manual actuator means comprises a rotary shaft, a handle on one end of said rotary shaft, a cam fixed to said rotary shaft and engageable with said reciprocal actuator member, whereby the movement of said handle to an operative position causes said switch actuator member to open said auxiliary switch.

3. The invention according to claim 2 further comprising a cam follower in operative engagement with said cam, said cam follower being operatively connected to said link means, whereby the movement of said handle to said operative position causes said air valve means to open.

4. The invention according to claim 3 in which said relief valve device is normally biased into open position, a lever actuator operatively connected to said relief valve device, to said link means, and to said cam follower whereby movement of said handle to said operative position simultaneously causes said relief valve device to close.

* * * * *